US009914228B1

(12) United States Patent
Matthews et al.

(10) Patent No.: US 9,914,228 B1
(45) Date of Patent: Mar. 13, 2018

(54) SMART CLIPPER

(71) Applicants: Michael Matthews, Washington, DC (US); Gregory Harvin, Washington, DC (US)

(72) Inventors: Michael Matthews, Washington, DC (US); Gregory Harvin, Washington, DC (US)

( * ) Notice: Subject to any disclaimer, the term of this patent is extended or adjusted under 35 U.S.C. 154(b) by 0 days.

(21) Appl. No.: 15/253,604

(22) Filed: Aug. 31, 2016

(51) Int. Cl.
*B26B 19/38* (2006.01)

(52) U.S. Cl.
CPC ..... *B26B 19/388* (2013.01); *B26B 19/382* (2013.01); *G10H 2240/325* (2013.01)

(58) Field of Classification Search
CPC ..... B26B 19/388; B26B 19/382; G10H 2240/325
USPC ..... 30/34.05
See application file for complete search history.

(56) References Cited

U.S. PATENT DOCUMENTS 4,474,480 A * 10/1984 Kato ..... G04C 3/00 368/223
4,965,504 A * 10/1990 Ueda ..... H02M 7/53873 318/727
4,965,779 A * 10/1990 Saruwatari ..... G04C 3/14 368/273
6,009,623 A * 1/2000 Orloff ..... B26B 21/4056 30/41.7
6,095,889 A * 8/2000 Demarinis ..... A63H 5/00 239/211
6,460,251 B1 * 10/2002 Orloff ..... B26B 21/4056 30/34.05
6,497,043 B1 * 12/2002 Jacobsen ..... B26B 21/40 132/200
7,654,003 B2 * 2/2010 Simms ..... B26B 21/405 30/34.05
8,594,870 B2 * 11/2013 Asahara ..... B60L 3/00 701/22
2002/0189102 A1 * 12/2002 Orloff ..... B25B 27/0014 29/897.3
2008/0209733 A1 * 9/2008 Johnson ..... A45D 27/22 30/41

* cited by examiner

*Primary Examiner* — Sean Michalski
(74) *Attorney, Agent, or Firm* — Jerry D Haynes; Law Office of Jerry D Haynes, PA

(57) ABSTRACT

A hair razor with interactive features including RPM control protocol that includes: an under side; an interactive display placed on the under side, where the interactive display provides access to display applications stored in memory; a top side; a digital display on the top side, where the digital display provides operational information related to the hair razor; a motor; a motherboard, where the motherboard is adapted to provide RPM control for the motor, wherein said RPM control is accomplished by syncing RPM speeds with musical notes; a USB connector on one side of the hair razor; a touch control button on the top side of the hair razor; and a power cord, the power cord supplies power to the hair razor. The interactive display is adapted to maneuver through a plurality of screen selections. The operational information shown on the digital display includes pitch tone associated with the RPM speed of the motor.

9 Claims, 3 Drawing Sheets

SMART CLIPPER

BACKGROUND OF THE INVENTION

Field of Invention

The present invention relates to a clipper or hair razor that includes interactive functions to provide additional features for the barber.

Description of Related Art

Hairstyling typically involves the use of an electric clipper for all the cutting and styling of the individual's hair. In addition to the electric hair clipper many times the stylist must also use a scissors for a finer cutting of the hair. However, the principal device used for cutting and styling of an individual's hair is the electric razor. The electric razor is typically handheld and has a set of rotating or vibrating blades that provide a cut of the hair. A barber or hairstylist guides the electric clipper through the individual's hair in the creation of the individual's hairstyle. Most hairstylists desire to remain current on hairstyles that are trending and are available for consumers. Typically this information is provided in the form of booklets or pamphlets that display various hairstyles. It is well known that the advent of small electronic displays have enabled interactive devices of various configurations that are able to provide a multitude of information for a user. The most prominent hand held interactive device is in the form of smartphones and cellular phone communications. These small displays provide users with various information and interaction through the use of applications that are used on a cellular phone. It would be advantageous to implement a similar interactive display on a hair razor. Such a display may provide adequate interaction for use with the hairstylist.

SUMMARY OF THE INVENTION

The present invention relates to a hair razor with interactive features including RPM control protocol that includes: an under side; an interactive display placed on the under side, where the interactive display provides access to display applications stored in memory; a top side; a digital display on the top side, where the digital display provides operational information related to the hair razor; a motor; a motherboard, where the motherboard is adapted to provide RPM control for the motor, wherein said RPM control is accomplished by syncing RPM speeds with musical notes; a USB connector on one side of the hair razor; a touch control button on the top side of the hair razor; and a power cord, the power cord supplies power to the hair razor. The interactive display is adapted to maneuver through a plurality of screen selections. The operational information shown on the digital display includes pitch tone associated with the RPM speed of the motor.

DETAILED DESCRIPTION

The present invention relates to a hair razor that has implemented interactive displays and software applications to provide information to the hairstylist. This interactive information may be displayed on two displays provided on a razor in accordance with the present invention. A first interactive control display is provided on an underside of the razor. A second display is provided on the forward side or top side of the razor that relates to particular operating information related to the razor. Further the present invention includes a USB connection that allows the transfer of data on storage within memory so that this information may be retrieved by the hairstylist. Further a small touch screen or thumb screen is provided to activate or provide other functionality related to the razor.

Figure 1:
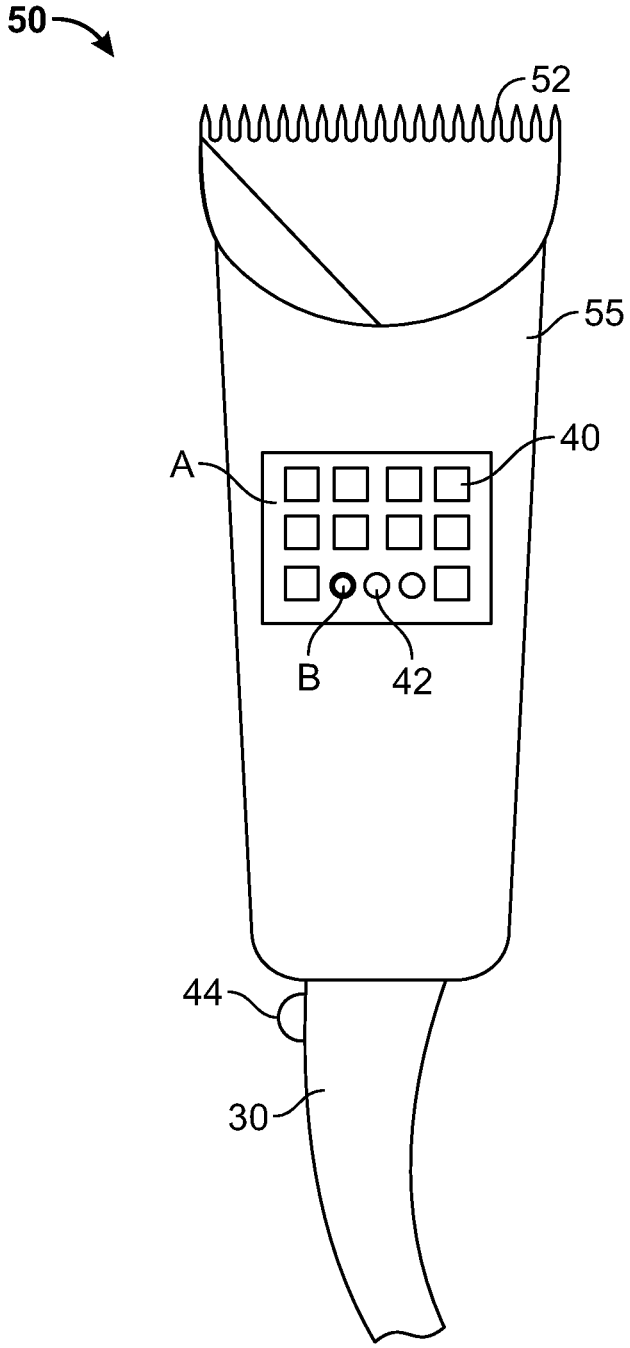
FIG. 1 displays an underside of a hair razor in accordance with the present invention.

With respect to FIG. 1, a razor 50 is shown in accordance with the present invention. Razor 50 has an underside 55 that includes an interactive control display 40. This interactive control display 40 is capable of being maneuvered through screen selections 42 provided on the display 40. Through use of this interactive control display 40 a user may access data stored in memory within the razor 50 for use by the hairstylist. In one particular embodiment, much of the data relates to hairstyling techniques and grooming styles that have been stored in memory within the razor 50. The razor 50 includes a set of cutting blades 52 and power supply through a power cord 30. A cord release 44 is also shown in FIG. 1.

Figure 2:
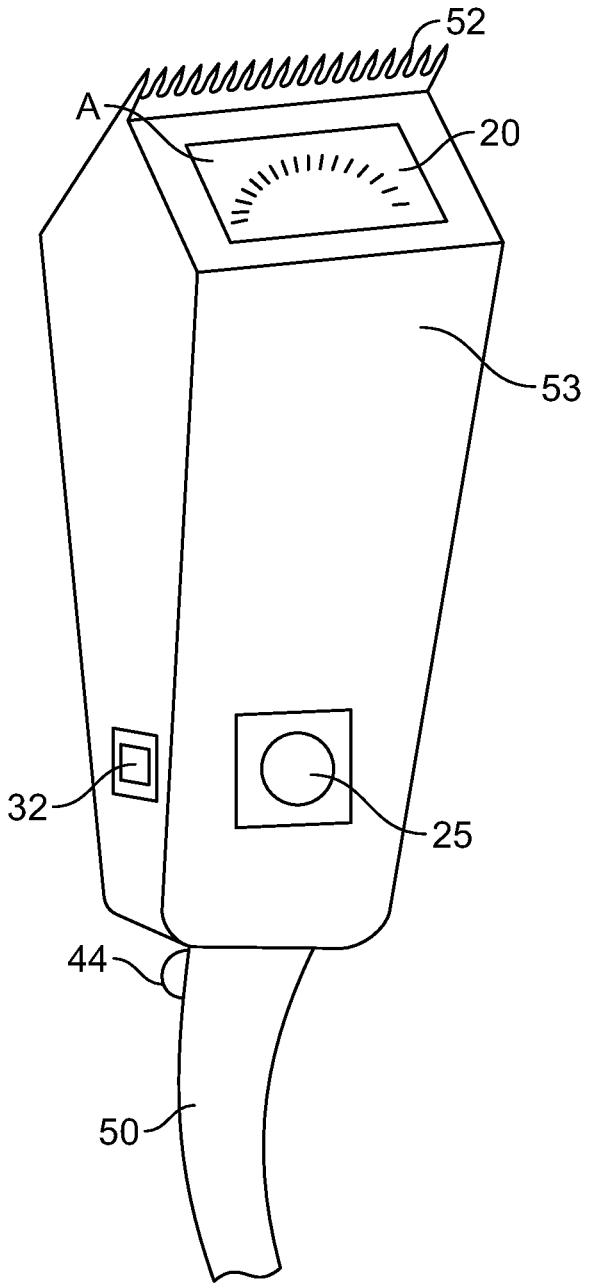
FIG. 2 depicts a top side of the hair razor in accordance with the present invention.

With respect to FIG. 2, a top side 53 of the razor 50 is shown. Along this top side 53 is a digital display screen 20. This digital display screen 20 provides operating information related to the razor 50. This operating information may include RPM, temperature controls and other operating information that may be controlled by the hairstylist through the use of the control display 40 on the underside 55. The razor 50 also includes a tuning mechanism, a motherboard and a variable speed motor. The digital display screen 20 may include a bar meter, a tuner and a RPM motor scale.

Preferably, the tuning mechanism on the side of the clipper is designed to adjust the perfect pitch/tone and octave notes pre-sets to an RPM motor scale. The tuning mechanism is wired to the motherboard which determines the command. The motherboard includes programming adapted to mimic a music scale system (C, D, E, F, G, A, B, C, etc.). The motherboard in the razor 50 is designed to convert RPMs to a perfect pitch/tone through notes and octaves. The music scales are programmed from low C to high C notes and are octave-repeating, meaning their pattern of notes is the same in every octave. An octave-repeating scale can be represented as a circular arrangement of pitch/tone and octave note settings, ordered by increasing (or decreasing) the pitch/tone and octave note of the motor's RPM. For instance, the increasing C major scale is C-D-E-F-G-A-B-[C], with the tuner indicating that the key last note is an octave higher than the first note, and the decreasing C major scale is C-B-A-G-F-E-D-[C], with the digital display indicating an octave lower than the first note in the scale. The tuner helps to keep the motor running at a preferred RPM setting. The visual aspect of the razor 50 is the digital display screen 20, which displays the tuner's RPM to ensure perfect pitch/tone and octave. The music scale system may be displayed on the front of the razor 50, which captures the pitch/tone, octave notes and motor RPM setting as digitally displayed. The digital display screen 20 captures three features: the bar meter which allows you to determine if the razor 50 is in perfect pitch/tone and octave; the tuner uses a music scale system which captures the motor pitch/tone setting; and the RPM shows the user the current speed. As result, the razor 50 allows the user to adjust according to different hair textures and skin types while being able to quickly identify the user's preferred settings for a precise cut each time.

Figure 3:
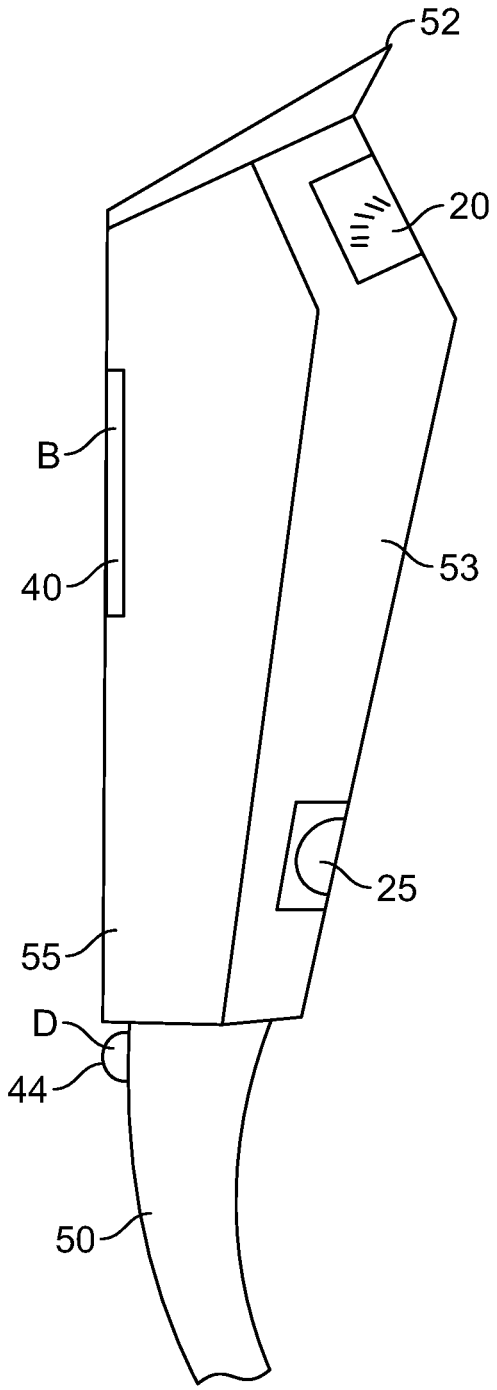
FIG. 3 depicts a side view of the hair razor in accordance with the present invention.

A USB connection 32 is also depicted for connection of the razor 50 with a computer. A touch input 25 is also provided on the top side 53 of the razor 50. This touch input 25 allows the hairstylist to power and control the razor 50. FIG. 3 depicts a side view of the razor 50 in accordance the present invention. In the side view, both display 20 and control display 40 are shown. During use a hairstylist may connect the razor to a computer to download various hairstyles and other data onto memory within the razor 50 for later use. Further this USB connection 32 provides for updating of any software that may operate on the razor that enables the functionality of the components associated with the razor 50. The instant invention has been shown and described in what it considers to be the most practical and preferred embodiments. It is recognized, however, that departures may be made there from within the scope of the invention and that obvious modifications will occur to a person skilled in the art.

What is claimed is:

1. A hair razor with interactive features including RPM control protocol comprising:

a. an under side;

b. an interactive display placed on the under side, where the interactive display provides access to display applications stored in memory;

c. a top side;

d. a digital display on the top side, where the digital display provides operational information related to the hair razor;

e. a motor;

f. a motherboard, where the motherboard is adapted to provide RPM control for the the motor, wherein said RPM control is accomplished by syncing RPM speeds with musical notes;

g. a USB connector on one side of the hair razor;

h. a touch control button on the top side of the hair razor; and i. a power cord, the power cord supplies power to the hair razor.

2. The hair razor according to claim 1, wherein the interactive display is adapted to maneuver through a plurality of screen selections.

3. The hair razor according to claim 1, where the operational information includes pitch tone associated with the RPM speed of the motor.

4. The hair razor according to claim 3, where interactive display is adapted to enable user adjustment of RPM speed.

5. The hair razor according to claim 1, wherein the memory includes data.

6. The hair razor according to claim 3, wherein the data includes hairstyling and grooming techniques.

7. The hair razor according to claim 1, wherein the razor includes a set of cutting blades.

8. The hair razor according to claim 1, wherein the operational information includes RPM and temperature controls.

9. The hair razor according to claim 1, wherein USB connector enables retrieval of data from a computer.

* * * * *